US007313933B2

(12) United States Patent
Carey et al.

(10) Patent No.: US 7,313,933 B2
(45) Date of Patent: Jan. 1, 2008

(54) LAUNDRY APPLIANCE UTILITY SHELF

(75) Inventors: Michael R. Carey, Coloma, MI (US); Darryl C. Bodine, St. Joseph, MI (US); Jean Marc Grosbuis, St. Joseph, MI (US); Moises Norena, St. Joseph, MI (US); Matthew G. Czach, Holland, MI (US); John H. Becker, St. Joseph, MI (US); Frank L. Brunacci, Granger, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 634 days.

(21) Appl. No.: 10/780,784

(22) Filed: Feb. 18, 2004

(65) Prior Publication Data

US 2005/0178165 A1 Aug. 18, 2005

(51) Int. Cl.
*D06F 37/26* (2006.01)
*D06F 39/00* (2006.01)

(52) U.S. Cl. ..... 68/3 R; 68/13 R; 312/228

(58) Field of Classification Search ..... 68/3 R, 68/13 R; 312/228, 228.1
See application file for complete search history.

(56) References Cited

U.S. PATENT DOCUMENTS

| | | | | |
|---|---|---|---|---|
| 2,786,730 | A | 3/1957 | Thurston | 312/315 |
| 4,993,786 | A * | 2/1991 | De Giulio | 312/298 |
| 5,037,165 | A * | 8/1991 | Rapp et al. | 312/330.1 |
| 5,651,278 | A | 7/1997 | Pinkowski | 68/134 |
| 7,082,783 | B2 * | 8/2006 | Uihlein et al. | 62/441 |
| 2002/0017117 | A1 * | 2/2002 | Sunshine et al. | 68/3 R |
| 2004/0221624 | A1 * | 11/2004 | Fumagalli | 68/17 R |
| 2004/0226320 | A1 * | 11/2004 | Bongini | 68/3 R |

FOREIGN PATENT DOCUMENTS

| | | |
|---|---|---|
| DE | 9013620 | 5/1991 |
| DE | 4228469 A1 | 5/1993 |
| DE | 9419048 | 3/1995 |
| DE | 9419048 U1 * | 3/1995 |
| DE | 20302573 | 4/2003 |
| EP | 1227182 | 7/2002 |
| EP | 1233100 | 8/2002 |
| FR | 2171084 | 9/1973 |

* cited by examiner

*Primary Examiner*—Joseph L. Perrin
(74) *Attorney, Agent, or Firm*—Michael D. Lafrenz; Clifton Green

(57) ABSTRACT

A laundry appliance having a cabinet enclosing a laundry treating mechanism, the cabinet having an openable door in a vertical front face thereof, is provided with a shelf recessed in the cabinet and arranged to be extendable to a horizontal position in an embodiment a predetermined distance below the door sufficient to allow a laundry basket to be placed on the shelf when extended and to allow the door to be opened and closed with the basket on the extended shelf and in an embodiment to provide a step for a user.

15 Claims, 6 Drawing Sheets

LAUNDRY APPLIANCE UTILITY SHELF

BACKGROUND OF THE INVENTION

Laundry appliances are well known, and include washers and dryers. Most dryers are front loading and have a horizontal axis about which a laundry fabric receiving drum rotates. Washers are sometimes top loading with a vertical axis about which a laundry fabric and wash liquor receiving wash basket rotates, and sometimes they are front loading with a horizontal rotary axis.

Typically, the interior of the drum or wash basket is accessed through a door in a cabinet of the laundry appliance that pivots between an open and a closed position. Particularly in the case of horizontal axis, front loading laundry appliances, it is known to elevate the appliance so that the access door is raised above the supporting floor for the appliance so that the use is not required to stoop over to load laundry fabric into or remove such fabric out of the appliance. In some instances a separate cabinet or pedestal is placed under the appliance to raise it above the floor, and sometimes the appliance itself is constructed so as to have a space below the drum or wash basket which is large enough to raise the drum and/or wash basket and the door of the cabinet a sufficient amount to provide the desired result.

While raising the appliance, or the drum and/or wash basket and door of the appliance helps the user when loading laundry fabric into or removing such fabric out of the appliance, oftentimes the laundry fabric is being removed from a laundry basket or hamper, or being returned to a laundry basket or hamper which remains supported on the floor, requiring the user to stoop down to the laundry basket during the laundry process.

It would be an improvement in the art if a device were provided that obviated the need for the user to stoop over to remove laundry fabric from a laundry basket during the loading process, or to stoop over to replace laundry fabric into the laundry basket during the unloading process.

SUMMARY OF THE INVENTION

The present invention provides a device which obviates the need for the user to stoop over to remove laundry fabric from a laundry basket during the loading process, or to stoop over to replace laundry fabric into the laundry basket during the unloading process.

In an embodiment of the invention, a laundry appliance having a cabinet enclosing a laundry treating mechanism, with the cabinet having an openable door in a vertical front face thereof; is provided which includes a shelf recessed in the cabinet and arranged to be extendable to a horizontal position a predetermined distance below the door sufficient to allow a laundry basket to be placed on the shelf when extended and to allow the door to be opened and closed with the basket on the extended shelf.

In an embodiment of the invention, the shelf may be incorporated into a drawer positioned below the door and the shelf may be slidable in the drawer, or may be pivotable relative to the drawer or the cabinet. Where there is a drawer, the shelf may be engagable with a portion of the drawer to secure the shelf in a fixed position relative to the drawer and the shelf may have an manually graspable opening therein to allow a person to disengage the shelf from the drawer.

In an embodiment of the invention, the shelf, in its extendable position, may be capable of supporting a user weighing in the range of 100 to 250 pounds or more.

In an embodiment of the invention, the shelf may be supported solely by runners in a cabinet structure positioned below the laundry treating mechanism.

In an embodiment of the invention, the shelf may be supported by rollers engaging a floor under the laundry treating mechanism.

In an embodiment of the invention, the shelf may be extendable via a user operated latch to release a catch, and a spring may be used to bias said shelf into the extendable position. In such an embodiment, the latch may be foot operated.

In an embodiment of the invention, a support is provided for a laundry appliance, where the appliance includes a cabinet having an openable door in a vertical front face thereof. The support may comprise a structure for positioning the door a predetermined distance above a floor and a shelf recessed in the structure and arranged to be extendable to a horizontal position below the door a predetermined distance sufficient to allow a laundry basket to be placed on the shelf when extended and to allow the door to be opened and closed with the basket on the extended shelf.

In an embodiment of the invention, the shelf may comprise a recessed compartment in a top surface thereof. In such an embodiment, there may also be an openable cover for the recessed compartment. Where there is a recessed compartment, the recessed compartment may be removable from the shelf.

In an embodiment of the invention, a support for a laundry appliance is provided. The support may include a structure for positioning the laundry appliance a predetermined distance above a floor. The support may also include a horizontally extendable and retractable drawer located in the structure. Also, the structure may include a shelf arranged in the drawer which is movable between a position to cover an interior of the drawer when the drawer is in an open position and a position to expose the interior of the drawer when the drawer is in the open position.

In an embodiment of the invention, the shelf may comprise a recessed compartment in a top surface thereof. When a recessed compartment is present, the shelf may also include an openable cover for the recessed compartment. When a cover is provided, the cover may be transparent to allow a user to view the contents of the compartment without opening the cover, or the cover may be opaque and colored complementary to or contrasting with a color of the shelf.

DETAILED DESCRIPTION OF THE PREFERRED EMBODIMENTS

The present invention provides a horizontal shelf in conjunction with a laundry appliance and its support structure, in which the shelf may have the utility of supporting a laundry basket, or the user—as in the form of a step. This invention may be provided in several different embodiments, some of which are shown in the Figures and described below, although the embodiments shown and illustrated are not exhaustive, but are merely illustrative of the present invention.

Figure 1:
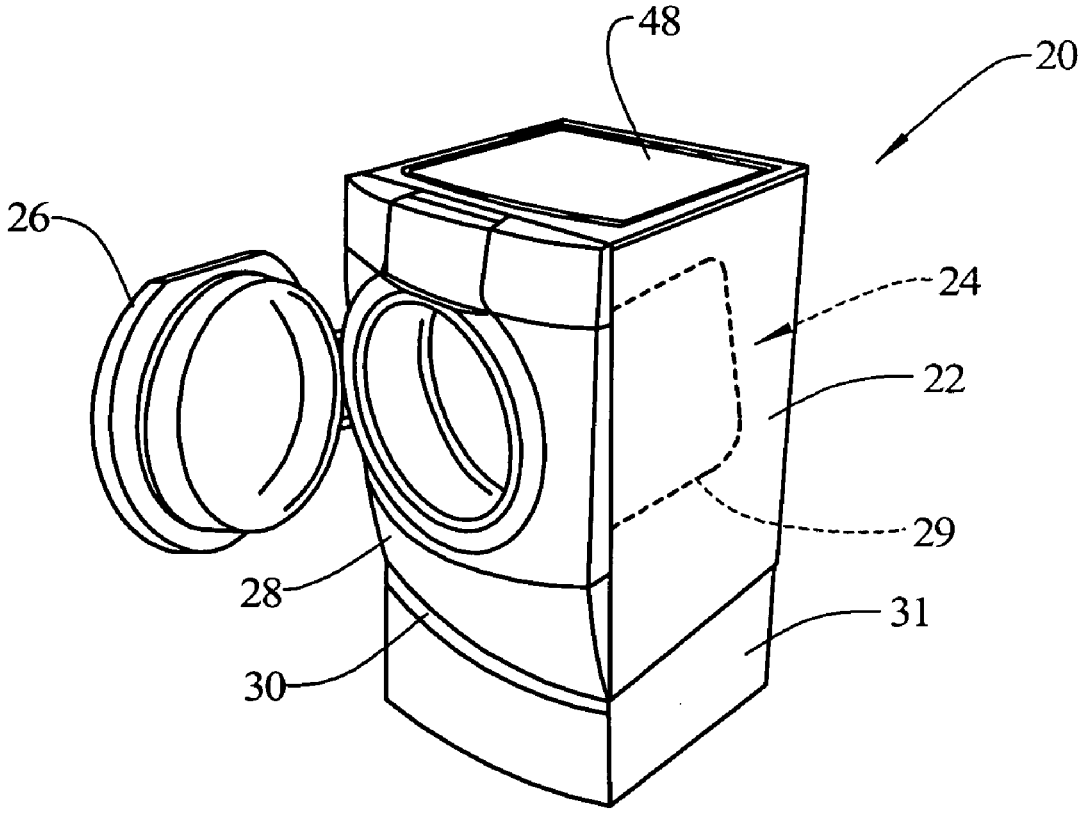
FIG. 1 illustrates a laundry appliance, in a perspective view, in which the present invention can be utilized.

An embodiment of the invention is illustrated in FIG. 1, which shows a laundry appliance 20 having a cabinet 22 enclosing a laundry treating mechanism 24, for example a fabric washing mechanism or a fabric drying mechanism. The cabinet 22 has an openable door 26 in a vertical front face 28 thereof, or in the case of a vertical axis washer, it would have an openable door in a horizontal top surface, such as in U.S. Pat. No. 5,651,278, the disclosure of which is incorporated herein by reference. The door 26 provides access to a horizontally rotatable vessel 29 such as a wash tub or dryer drum. The cabinet 22 may extend down to the floor supporting the appliance 20, or the appliance may be positioned on a separate support pedestal 31, such that the cabinet 22 is positioned above the floor. In general however, a supporting structure, whether within, or separate from, the cabinet 22 is used to position the laundry treating mechanism 24 and the door 26 above the floor by a distance, greater than the mechanism 24 itself would dictate.

A shelf 30 is recessed in the cabinet 22 or the support pedestal 31 and is arranged to be moved to an extended horizontal position below the door 26 a predetermined distance 32 (FIG. 2) sufficient to allow a laundry basket 34 to be placed on the shelf when extended and to allow the door to be opened and closed with the basket on the extended shelf. Typically such laundry baskets have a height in the range of 9 inches to 15 inches, so the distance 32 should preferably be in the range of 9 inches to 18 inches.

In an embodiment of the invention shown in FIG. 3, the shelf 30 is incorporated into a drawer 38 positioned below the door 26 and the shelf may be slidable in the drawer. In this manner, the shelf 30 may be movable between a forward position to cover an interior of the drawer 38 when the drawer is in an open position and a rearward position to expose the interior of the drawer when the drawer is in the open position. To accommodate the sliding, the drawer 38 may be provided with horizontal tracks or ledges 40 on which the shelf 30 is slidably supported. The shelf 30 may alternatively be provided with rollers or may be carried on extendable arms or may be slidably attached to the drawer 38 in other similar ways as is known in the art.

In some embodiments (shown in FIGS. 3, 9 and 10), the shelf 30 may have an manually graspable opening 42 therein to allow a person to easily grasp the shelf to disengage the shelf from the drawer 38 or to assist in the sliding or pivoting of the shelf.

In an embodiment of the invention, such as shown in FIGS. 4-7, the shelf 30 may be pivotable relative to the drawer 38 or the cabinet 22. In this manner, the shelf 30 (in FIGS. 4 and 5) may be movable between a downward position to cover the interior of the drawer 38 when the drawer is in an open position and an upward position to expose the interior of the drawer when the drawer is in the open position. When the shelf 30 is used in conjunction with the drawer 38, the shelf may be pivotally attached near a rear 44 of the drawer so that the shelf may be pivoted upwardly when the drawer is in the open position to provide access to storage space within the drawer below the shelf. The shelf 30 may also be pivoted midway along the depth of the drawer 38 so that the shelf may be pivoted upwardly when the drawer is extended to less than a full open position.

Figure 4:
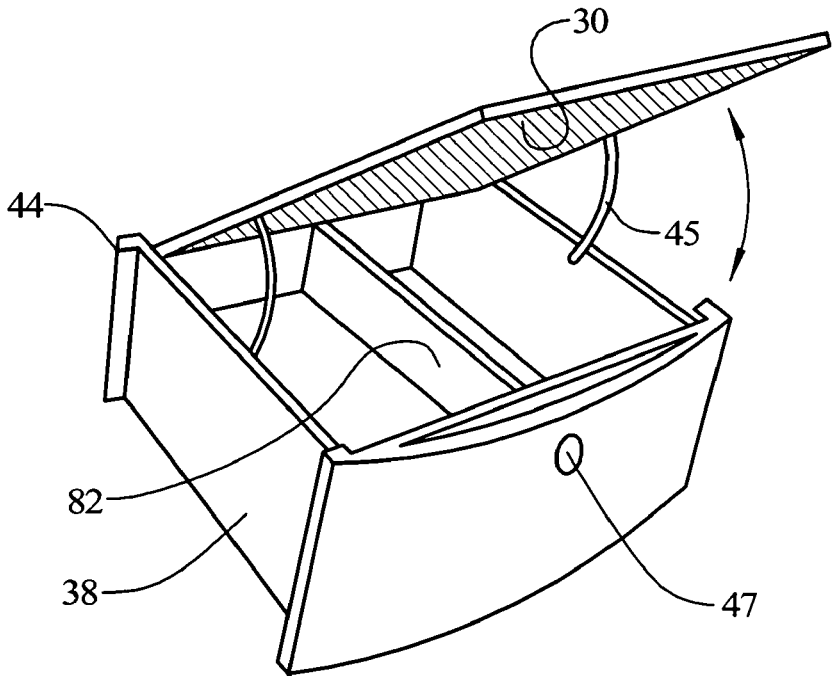
FIG. 4 illustrates a schematic perspective view of a drawer component of a support structure with an embodiment of the present invention.
Figure 5:
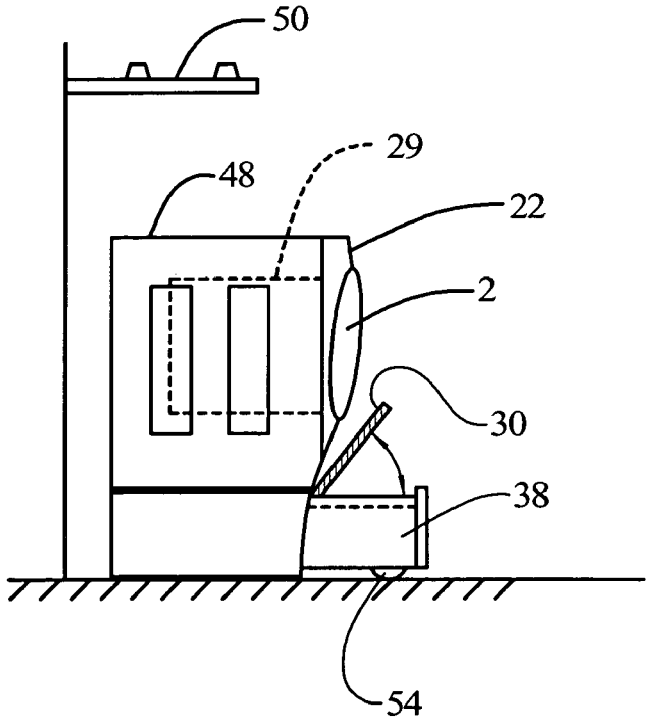
FIG. 5 illustrates a side elevational view of a laundry appliance and support structure incorporating an embodiment of the present invention.
Figure 6:
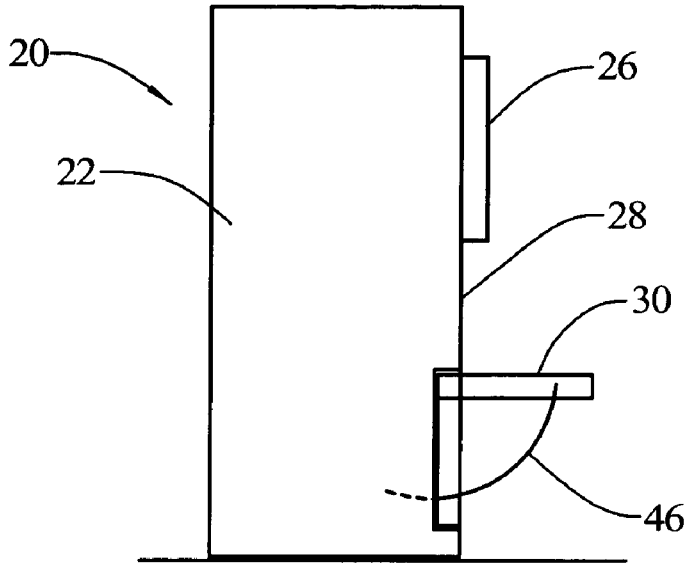
FIG. 6 illustrates a side elevational view of a laundry appliance and support structure incorporating an embodiment of the present invention.
Figure 7:
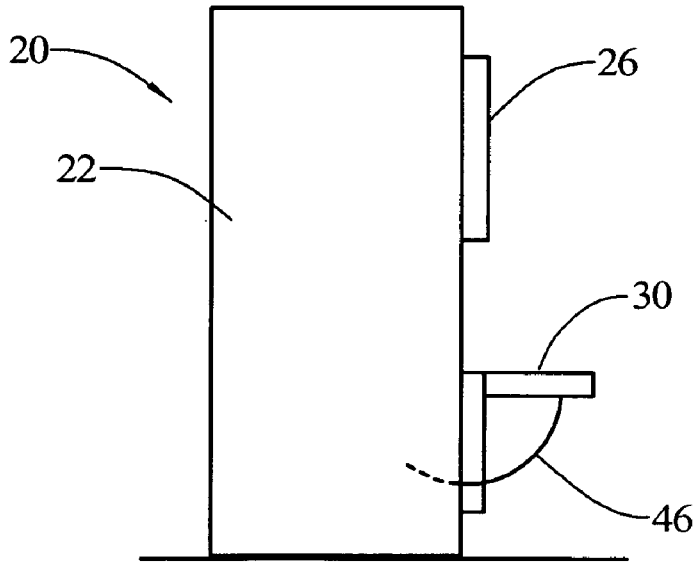
FIG. 7 illustrates a side elevational view of a laundry appliance and support structure incorporating an embodiment of the present invention.

In a drawer covering shelf embodiment, such as shown in FIGS. 4 and 5, the shelf 30 may be provided with releasable support arms 45 to releasably support the shelf in a raised access position, yet allowing the shelf to be easily returned to a horizontal use position. The drawer 38 may also be provided with a lock 47 to prevent unauthorized access to the contents of the drawer.

When the shelf 30 is provided in the cabinet 22 or support pedestal 31 separate from the drawer 38, the shelf may be pivoted relative to the cabinet to move into an extended basket supporting position, such as pivoting from a surface mounted (FIG. 7) or recessed (FIG. 6) position relative to the front 28 of the appliance cabinet. In such embodiments, releasable support arms 46 would typically be provided for releasably supporting the shelf 30 in a horizontal extended use position, yet allowing the shelf to be easily returned to a vertical stored position.

In an embodiment of the invention, the shelf 30, in its extended position, may be capable of supporting a user weighing in the range of 100 to 250 pounds or more, such that the shelf may be used as a step for the user who may wish to access storage space above the appliance cabinet, such as a top surface 48 of the appliance cabinet 22 or a shelving unit 50 (FIG. 5) positioned above the appliance cabinet. The shelf 30 as a step may also be used to allow users to more easily access an interior of the appliance laundry vessel 29. When the shelf 30 is to be utilized as a step, in some embodiments, the shelf may be positioned closer to the cabinet door 26 then the typical height of a laundry basket 34.

In an embodiment of the invention as shown in FIG. 5, the shelf 30 may be supported by rollers 54 engaging the floor under the laundry treating mechanism. These rollers may be provided to assist the sliding movement of the shelf 30 (or drawer 38) relative to the cabinet 22 and may also be used to support the shelf in its extended position to support the weight of a user, which weight may be in the rage of 100 to 250 pounds, or the weight of a heavy laundry basket which may be in the range of 10 to 50 pounds.

Figure 2:
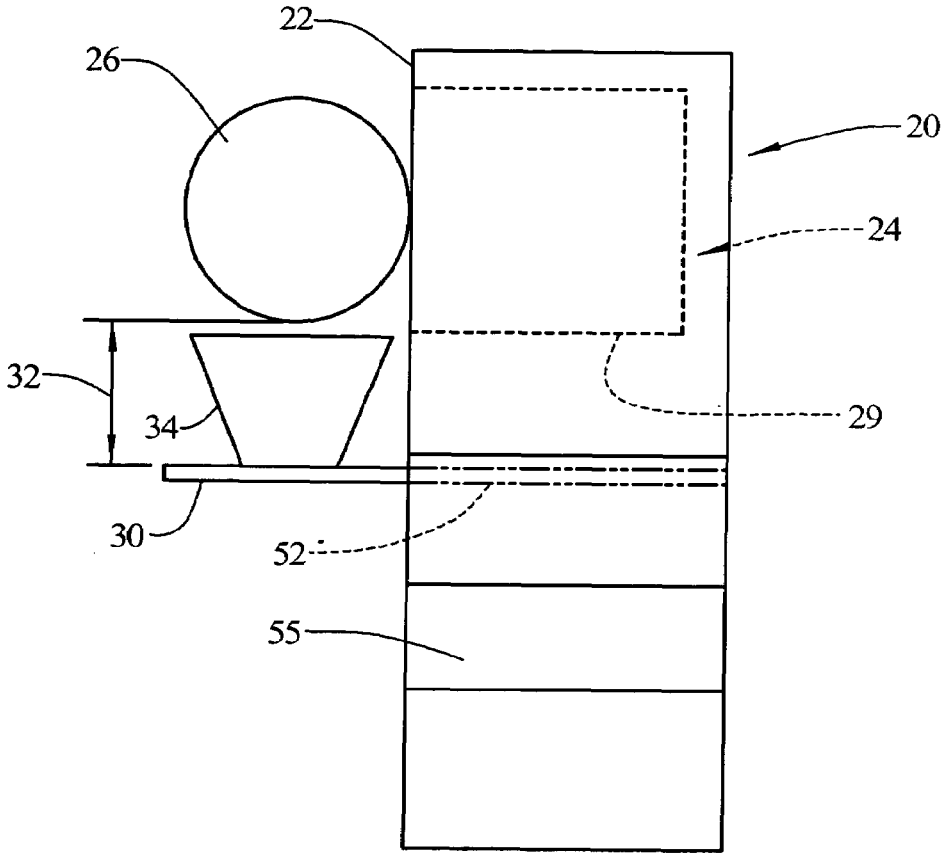
FIG. 2 illustrates a laundry appliance and support structure in a schematic side elevational view incorporating an embodiment of the present invention.

In an embodiment of the invention as shown in FIG. 2, the shelf 30 may be slidably supported solely by runners or extendable arms 52 secured within a supporting structure 55 positioned below the laundry treating mechanism 24 and without being associated with a drawer. The supporting structure 55 may be a part of the appliance cabinet 22 or may be in a separate supporting pedestal 31.

Figure 8:
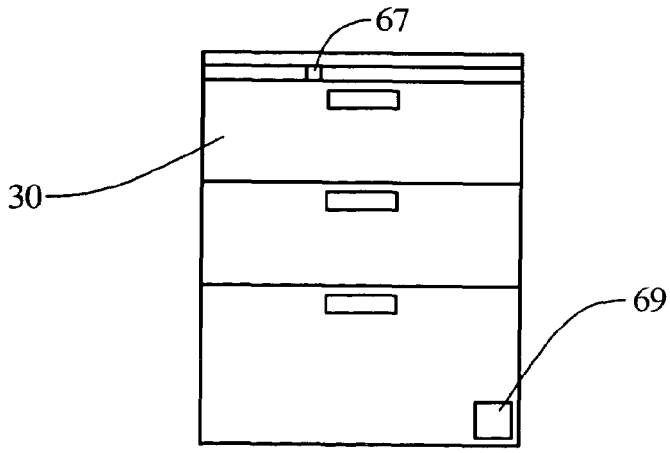
FIG. 8 illustrates a front elevational view of a laundry appliance support structure incorporating an embodiment of the present invention.

In an embodiment of the invention, the shelf 30 may be extendable via a user operated latch, and one or more springs may be used to bias the shelf into the extended position. The latch may be in the form of a pivotable lever having a portion that may move into a blocking position with a portion of the shelf 30, or may be in the form of an axially movable pin engageable with the shelf or a hole therein, or other similar latching arrangements as are known in the art. In such an embodiment, the latch may be hand or foot operated, such as through the operation of a push button 67 or a foot operated pedal 69 (FIG. 8). When the user operates the latch 60, the shelf 30 will automatically move to the extended position by operation of the spring 62, and when the user pushes the shelf into the retracted position, the latch will hold the shelf in that position until the user again releases the latch.

Figure 9:
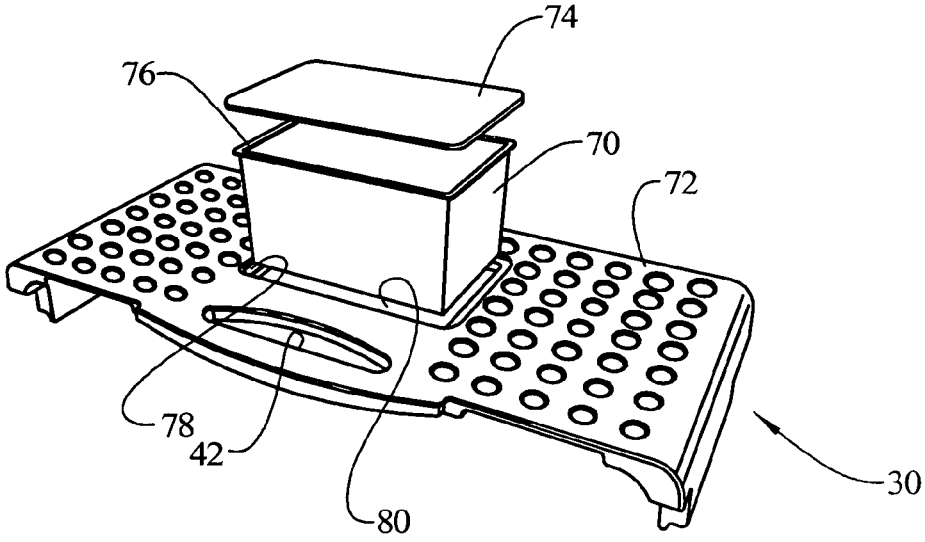
FIG. 9 illustrates components of a shelf system incorporating an embodiment of the present invention.

In an embodiment of the invention best illustrated in FIG. 9, the shelf 30 may comprise a recessed compartment 70 in a top surface 72 thereof. In such an embodiment, there may also be an openable cover 74 for the recessed compartment 70, for example a pivoting cover. Where there is a recessed compartment 70, the recessed compartment may be removable from the shelf 30. For example, the compartment 70 may be formed with a circumferential flange 76 which rests on a ledge 78 formed in the shelf 30 surrounding an opening 80 sized to receive the compartment. When the user wishes to utilize the compartment 70 to store small items, the compartment will be placed in the opening 80 and held in place by the engagement of the flange 76 with the ledge 78. In such an arrangement, if the compartment 70 has a significant depth, it will extend below a bottom surface of the shelf 30 into the space of the drawer 38 below the shelf. When the user wishes to utilize the full height of the drawer 38 below the shelf 30, even in the area below the opening 80, the compartment 70 can be removed so that it will not extend down into the space below the shelf. The cover 74 may remain attached to the shelf 30, even with the compartment 70 removed so that the opening 80 will remain covered.

The cover 74 may be made of a transparent material so that the contents of the compartment 70 may be viewed, even with the cover closed, or the cover may be made of an opaque material and colored to blend in with the color of the shelf top surface 72, or to contrast with it.

In an embodiment utilizing a drawer 38, the shelf 30 may be part of a drawer insert system which includes additional parts such as one or more drawer dividers 82 (FIGS. 3 and 4) which extend from one side of the drawer to the other, such as from the front to the rear, to divide the space within the drawer into smaller individual compartments. The dividers 82 may alternatively extend from one lateral side to the other.

Figure 3:
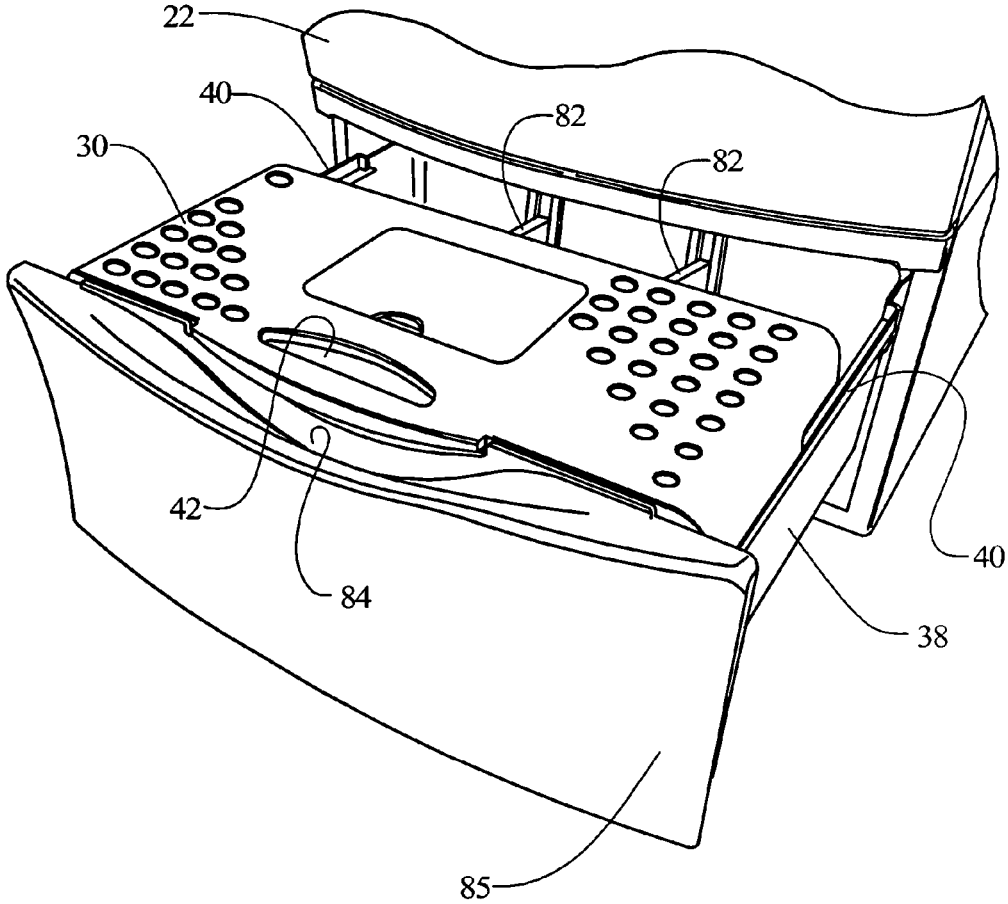
FIG. 3 illustrates a partial perspective view of a laundry appliance support structure with an embodiment of the present invention.

In an embodiment where there is a drawer 38, such as shown in FIG. 3, a portion of the shelf 30 may be engageable with an insert or a portion of the drawer, such as a drawer backer portion 84 of a front wall 85 of the drawer, to secure the shelf in a fixed position relative to the drawer. The engagement between the shelf 30 and the drawer 38 could be a friction fit or could make use of detents, such as a tongue and groove arrangement, or spring loaded catches, or other similar engaging mechanisms as is known in the art. Since there will not be any large horizontal forces acting on the drawer 38 relative to the shelf 30, or vice versa, the engaging mechanism need not have a great holding power, but could be useful to prevent relative movement between the shelf and the drawer when the drawer is opened or closed and unless specifically desired by the user.

Figure 10:
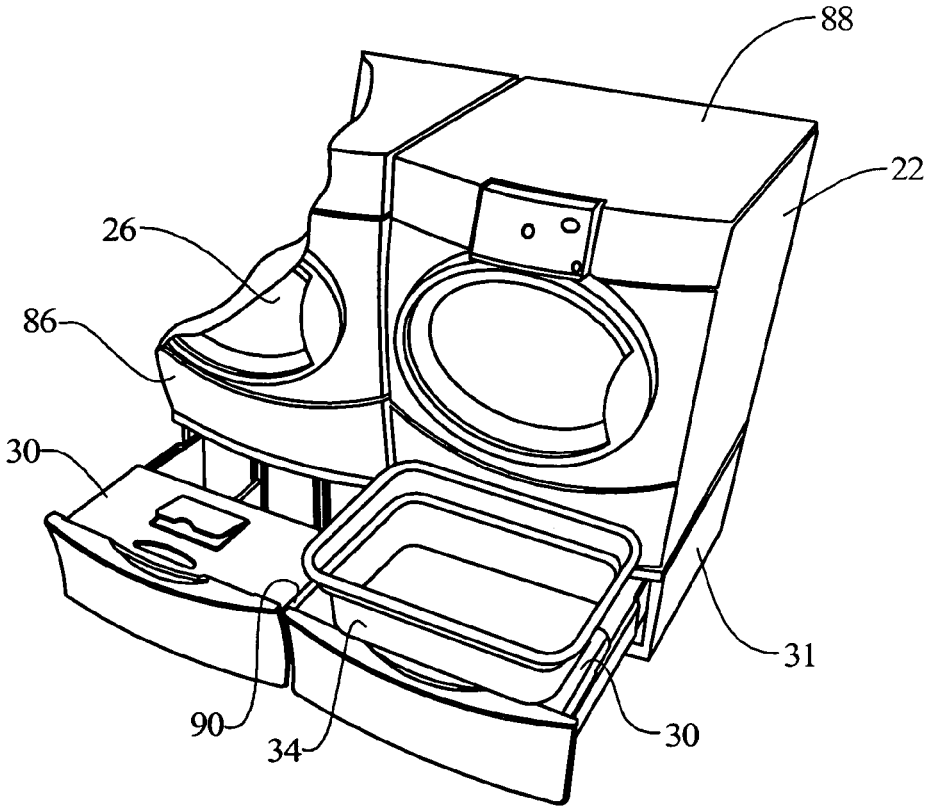
FIG. 10 illustrates a pair of laundry appliances and support structures, in perspective, incorporating an embodiment of the present invention.

In a typical laundry arrangement as shown in FIG. 10, a washer appliance 86 and a dryer appliance 88 are both provided, generally in a side by side arrangement. By utilizing aspects of the present invention, both the washer and the dryer mechanisms and the cabinet doors 26 would be elevated above the floor and retractable and extendable shelves 30 would be provided below the washer and dryer mechanisms, whether in the cabinets 22 for the washer 86 and dryer 88 or in a separate support pedestal 31. When both shelves 30 are extended, a relatively continuous surface would be provided, and although it has a gap 90 therein between the two individual shelf units, the gap would be considerably smaller than the length of the laundry basket 34, thereby allowing the basket to be slid between the two shelves, again to prevent the user from having to stoop over to pick up or move the laundry basket when transferring laundry from one appliance to the other.

The shelf 30, and the various other components of the insert system, may be formed from a variety of materials as desired, or as required, depending on the load to be supported. For example, when the shelf 30 is used to support the weight of a laundry basket 34, but not a person, the shelf may be constructed of a molded plastic material. The shelf could also be formed from metal, wood or a combination of such materials. When the shelf is to be used to support greater weights, such as the weight of a user, the materials and their thicknesses should be selected so as to be able to support such weight, and may include any of the materials discussed, or combinations of such materials.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A laundry appliance having:

a cabinet enclosing a laundry treating mechanism;

said cabinet having an openable door in a vertical front face thereof;

a drawer slidably attached to said cabinet;

a shelf mounted to said drawer, said shelf slidably movable between a horizontal forward position to cover an interior of said drawer when said drawer is in an open position and a horizontal rearward position to expose said interior of said drawer when said drawer is in said open position; and said shelf positioned a predetermined distance below said door sufficient to allow a laundry basket to be placed on said shelf when extended and to allow said door to be opened and closed with said basket on said extended shelf.

2. A laundry appliance according to claim 1, wherein said shelf is engageable with a portion of said drawer to secure said shelf in a fixed position relative to said drawer and said shelf has an manually graspable opening therein to allow a person to disengage said shelf from said drawer.

3. A laundry appliance according to claim 1, wherein said shelf, in its extendable position, is capable of supporting a user weighing in the range of 100 to 250 pounds.

4. A laundry appliance according to claim 1, wherein said shelf is supported by rollers engaging a floor under said laundry treating mechanism.

5. A laundry appliance according to claim 1, wherein said shelf comprises a recessed compartment in a top surface thereof.

6. A laundry appliance according to claim 5, including an openable cover for said recessed compartment.

7. A laundry appliance according to claim 5, wherein said recessed compartment is removable from said shelf.

8. A support for a laundry appliance, comprising:

a structure for positioning said laundry appliance a predetermined distance above a floor;

a horizontally extendable and retractable drawer located in said structure;

a shelf arranged in said drawer, said shelf slidably movable between a horizontal forward position to cover an interior of said drawer when said drawer is in an open position and a horizontal rearward position to expose said interior of said drawer when said drawer is in said open position; and said shelf comprises a recessed compartment in a top surface thereof, said shelf top surface has an opening therein which is surrounded by a ledge area, said recessed compartment including a body portion receivable in said opening and a lip surrounding said body portion, which lip rests on said ledge area when said body is received in said opening, said top surface further including an openable cover arranged to lie over said recessed compartment substantially coplanar with said top surface of said shelf when said recessed compartment is present in said shelf and to lie over said opening when said recessed compartment is removed from said shelf.

9. A support according to claim 8, including an openable cover for said recessed compartment.

10. A support according to claim 9, wherein said cover is transparent.

11. A support according to claim 8, wherein said recessed compartment is removable from said shelf.

12. A support according to claim 8, wherein said shelf, in its extendable position, is capable of supporting a user weighing in the range of 100 to 250 pounds.

13. A support according to claim 8, wherein said shelf is supported by rollers engaging a floor under said laundry treating mechanism.

14. A support for a laundry appliance, comprising:

a structure for positioning said laundry appliance a predetermined distance above a floor;

a horizontally extendable and retractable drawer located in said structure; and a shelf arranged in said drawer which is movable between a position to cover an interior of said drawer when said drawer is in an open position and a position to expose said interior of said drawer when said drawer is in said open position;

a recessed compartment in a top surface of said shelf;

said shelf top surface has an opening therein which is surrounded by a ledge area, said recessed compartment including a body portion receivable in said opening and a lip surrounding said body portion, which lip rests on said ledge area when said body is received in said opening, said top surface further including an openable cover arranged to lie over said recessed compartment substantially coplanar with said top surface of said shelf when said recessed compartment is present in said shelf and to lie over said opening when said recessed compartment is removed from said shelf.

15. A support according to claim 14, wherein said cover is transparent.

* * * * *